US009675995B1

(12) United States Patent
Lowe, Jr.

(10) Patent No.: US 9,675,995 B1
(45) Date of Patent: Jun. 13, 2017

(54) METHOD OF CREATING DECORATIVE ARTWORK

(71) Applicant: Richard Allen Lowe, Jr., Fort Lauderdale, FL (US)

(72) Inventor: Richard Allen Lowe, Jr., Fort Lauderdale, FL (US)

( * ) Notice: Subject to any disclaimer, the term of this patent is extended or adjusted under 35 U.S.C. 154(b) by 0 days.

(21) Appl. No.: 15/347,852

(22) Filed: Nov. 10, 2016

Related U.S. Application Data

(63) Continuation of application No. 15/341,511, filed on Nov. 2, 2016, now abandoned.

(51) Int. Cl.

| | |
|---|---|
| ***B05D 1/38*** | (2006.01) |
| ***B44C 3/02*** | (2006.01) |
| ***B05D 3/00*** | (2006.01) |
| ***B05D 5/06*** | (2006.01) |
| ***B05D 3/10*** | (2006.01) |
| ***B05D 1/00*** | (2006.01) |

(Continued)

(52) U.S. Cl.

CPC ..... *B05D 1/38* (2013.01); *B05D 1/00* (2013.01); *B05D 1/26* (2013.01); *B05D 1/30* (2013.01); *B05D 1/34* (2013.01); *B05D 1/36* (2013.01); *B05D 3/007* (2013.01); *B05D 3/107* (2013.01); *B05D 3/108* (2013.01); *B05D 3/12* (2013.01); *B05D 5/06* (2013.01); *B05D 5/061* (2013.01); *B05D 5/062* (2013.01); *B05D 7/50* (2013.01); *B05D 7/56* (2013.01); *B05D 7/57* (2013.01); *B05D 7/574* (2013.01); *B05D 7/576* (2013.01); *B05D 7/577* (2013.01); *B05D 7/58* (2013.01); *B05D 7/584* (2013.01); *B05D 7/586* (2013.01); *B05D 7/587* (2013.01); *B44C 3/02* (2013.01); *B05D 2502/00* (2013.01); *B05D 2504/00* (2013.01)

(58) Field of Classification Search

CPC ... B05D 1/00; B05D 1/26; B05D 1/30; B05D 1/34; B05D 1/36; B05D 1/38; B05D 3/007; B05D 3/107; B05D 3/108; B05D 3/12; B05D 5/06; B05D 5/061; B05D 5/062; B05D 7/50; B05D 7/56; B05D 7/57; B05D 7/574; B05D 7/576; B05D 7/577; B05D 7/58; B05D 7/584; B05D 7/586; B05D 7/587; B05D 2504/00; B05D 2502/00

USPC ..... 427/256, 261, 270, 271, 273, 274, 331, 427/345, 346

See application file for complete search history.

(56) References Cited

U.S. PATENT DOCUMENTS

| | | | | |
|---|---|---|---|---|
| 7,384,667 | B2 * | 6/2008 | Blanco | B44F 11/02 345/419 |
| 2003/0035917 | A1 * | 2/2003 | Hyman | B41M 1/30 428/67 |

FOREIGN PATENT DOCUMENTS

JP 08-158581 A * 6/1996

* cited by examiner

*Primary Examiner* — William Phillip Fletcher, III

(74) *Attorney, Agent, or Firm* — The Concept Law Group, P.A.; Scott D. Smiley

(57) ABSTRACT

A method of creating decorative artwork including providing a wall-mountable substrate having a paint-receiving upper surface and a wall-mounting surface opposite the paint-receiving upper surface, applying a first coat of resin to the paint-receiving upper surface, applying a metallic substance to the paint-receiving upper surface, and applying a sealer including a quantity of volatile organic compounds to the paint-receiving upper surface at a velocity sufficient to (Continued)

disperse at least one of the first coat of resin and the metallic substance in a plurality of directions with respect to the paint-receiving upper surface to create at least one decorative marking.

20 Claims, 7 Drawing Sheets

(51) Int. Cl.

| | |
|---|---|
| ***B05D 1/36*** | (2006.01) |
| ***B05D 3/12*** | (2006.01) |
| ***B05D 1/26*** | (2006.01) |
| ***B05D 1/30*** | (2006.01) |
| ***B05D 1/34*** | (2006.01) |
| ***B05D 7/00*** | (2006.01) |

METHOD OF CREATING DECORATIVE ARTWORK

CROSS REFERENCE TO RELATED APPLICATION

This application is a continuation of and claims priority to U.S. patent application Ser. No. 15/341,511, filed Nov. 2, 2016, now abandoned.

FIELD OF THE INVENTION

The present invention relates generally to painting, and, more particularly, relates to a method of creating decorative artwork by using a resin and a volatile sealer.

BACKGROUND OF THE INVENTION

It is well known that materials, such as resin, are used by individuals to coat or laminate artwork. Although there are numerous methods of applying the resin to the artwork, little attention has been paid to methods of using a sealer including a level of volatile organic compounds, i.e., a volatile sealer, in conjunction with the resin to actually create the artwork viewed by a user. Said another way, many known methods of creating artwork use the resin as a top coat or a laminate over the artwork, as opposed to combining the resin and the volatile sealer to produce the images portrayed within the artwork itself.

Methods of using resin and a sealer to produce colorful and patterned flooring and countertops are also known. When using the sealer, e.g., a topical or penetrating concrete sealer, to produce the flooring or countertop, the sealer is often applied in one or more layers over the floor or countertop to provide a waterproof top coat, as opposed to the sealer being used to create the actual pattern visible on the floor. Moreover, when creating resin flooring, users must exercise extreme caution and account for outside elements, such as dust, temperature, humidity, and the quality of the resin because the floor or countertop should be seamless. Therefore, the application of the resin and the sealer must take place in a specific order and manner without interruptions, leaving the user with no ability to exercise control over when and how the materials are applied to the floor. Said another way, these known methods fail to provide the user with the ability to exercise creativity and control over the timing, mixing, and application of the resin and the sealer to create a distinctive decorative image which may have a unique multi-dimensional appearance.

Therefore, a need exists to overcome the problems with the prior art as discussed above.

SUMMARY OF THE INVENTION

The invention provides a method of creating decorative artwork that overcomes the hereinafore-mentioned disadvantages of the heretofore-known devices and methods of this general type and that provides an aesthetically appealing wall-mountable substrate having at least one decorative marking produced using a coat of resin and a sealer including a quantity of volatile organic compounds.

With the foregoing and other objects in mind, there is provided, in accordance with the invention, a method of creating decorative artwork, the method including providing a wall-mountable substrate having a paint-receiving upper surface opposite a wall-mounting surface; applying a first coat of resin to the paint-receiving upper surface; applying a metallic substance to the paint-receiving upper surface; and applying a sealer including a quantity of volatile organic compounds to the paint-receiving upper surface at a velocity sufficient to disperse at least one of the first coat of resin and the metallic substance in a plurality of directions with respect to the paint-receiving upper surface to create at least one decorative marking.

In accordance with another feature of the present invention, the method of creating decorative artwork includes mixing the metallic substance with the first coat of resin, such that the step of applying a first coat of resin to the paint-receiving upper surface and the step of applying a metallic substance to the paint-receiving upper surface are performed in a single step.

In accordance with a further feature of the present invention, the method of creating decorative artwork includes manually tilting the wall-mountable substrate at an angle to spread the first coat of resin over a portion of the paint-receiving upper surface.

In accordance with another feature of the present invention, the method of creating decorative artwork includes curing the first coat of resin to a user-selected cure level that is between a range of 1 to 10, with 1 being a liquid state and 10 being a full hardness property.

In accordance with a further feature of the present invention, the method of creating decorative artwork includes applying a second coat of resin to the paint-receiving upper surface, such that the second coat of resin is at least partially isolated from the first coat of resin; applying at least one of the metallic substance and a second metallic substance to the second coat of resin; and applying the sealer including the quantity of volatile organic compounds to the paint-receiving upper surface at a velocity sufficient to disperse at least one of the second coat of resin and the second metallic substance in a plurality of directions with respect to the paint-receiving upper surface to create a second decorative marking having a 3D appearance.

In accordance with a further feature, the method of creating decorative artwork also includes allowing the first coat of resin to drip over at least a portion of a perimeter of the wall-mountable substrate; collecting a quantity of the first coat of resin that dripped over the at least a portion of the perimeter of the wall-mountable substrate; and distributing the quantity of the first coat of resin that dripped over the at least a portion of the perimeter of the wall-mountable substrate back onto the paint-receiving upper surface.

In accordance with another feature of the present invention, the method of creating decorative artwork includes mixing the sealer into the first coat of resin prior to applying the first coat of resin to the paint-receiving upper surface.

In accordance with another further feature of the present invention, the method of creating decorative artwork includes applying the sealer to the paint-receiving upper surface from a user selected height that is at least thirty six inches away from the paint-receiving upper surface.

In accordance with another feature of the present invention, the sealer is at least one of a topical sealer and a penetrating sealer.

In accordance with a further feature of the present invention, the method of creating decorative artwork includes mounting the wall-mounting structure of the wall-mountable substrate on a wall surface of a building structure.

In accordance with the present invention, a method of creating artwork is disclosed, the method including providing a piece of canvas having a paint-receiving upper surface and a mounting surface opposite the paint-receiving upper surface; applying a first coat of resin to the paint-receiving upper surface; curing the first coat of resin to a user-selected cure level of a viscosity greater than a liquid level and less than full hardness level; applying a metallic substance to the paint-receiving upper surface; and applying a sealer including a quantity of volatile organic compounds to the metallic substance when the first coat of resin reaches the user-selected cure level, such that the sealer disperses the metallic substance in a plurality of directions with respect to the paint-receiving upper surface to create at least one decorative marking.

In accordance with another feature of the present invention, the method of creating artwork includes applying a second coat of resin to the paint-receiving upper surface; mixing the metallic substance with at least one of the first coat of resin and the second coat of resin; and applying the sealer to the metallic substance and the at least one of the first coat of resin and the second coat of resin to create the at least one decorative marking.

In accordance with a further feature of the present invention, the method of creating artwork further includes manually tilting the piece of canvas to a user-selected angle to spread at least one of the first coat of resin and the second coat of resin over a portion of the paint-receiving upper surface.

In accordance with another feature of the present invention, the method of creating artwork includes allowing the first coat of resin to drip over at least a portion of a perimeter of the piece of canvas; collecting a quantity of the first coat of resin that dripped over the at least a portion of the perimeter of the wall-mountable substrate; and distributing the quantity of the first coat of resin that dripped over the at least a portion of the perimeter of the wall-mountable substrate back onto the paint-receiving upper surface.

In accordance with another feature of the present invention, the sealer is one of an acrylic sealer and an epoxy sealer.

In accordance with a further feature of the present invention, the at least one decorative marking includes a multi-dimensional appearance.

In accordance with the present invention, a method of creating decorative artwork is disclosed, the method including providing a substrate having a paint-receiving upper surface opposite a mounting surface; applying a coat of resin to the paint-receiving upper surface; curing the coat of resin to a user selected cure level of a viscosity greater than a liquid level and less than full hardness level; applying a metallic substance to the paint-receiving upper surface; and releasing a sealer including a quantity of volatile organic compounds onto the paint-receiving upper surface at a user selected time period from a velocity sufficient to disperse at least one of the coat of resin and the metallic substance over a portion of the paint-receiving upper surface to create at least one decorative marking.

In accordance with another feature of the present invention, the sealer is a concrete sealer.

In accordance with a further feature of the present invention, the method of creating decorative artwork includes applying a second coat of resin to the paint-receiving upper surface; applying at least one of the metallic substance and a second metallic substance to the second coat of resin; and applying the sealer including the quantity of volatile organic compounds to the paint-receiving upper surface at the velocity sufficient to disperse the second metallic substance in a plurality of directions with respect to the paint-receiving upper surface to create a second decorative marking different than the at least one decorative marking.

In accordance with another feature of the present invention, the method of creating decorative artwork further includes manually tilting the substrate at an angle to spread the coat of resin over a portion of the paint-receiving upper surface.

Although the invention is illustrated and described herein as embodied in a method of creating decorative artwork, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the piece of canvas from a first end to a second end.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
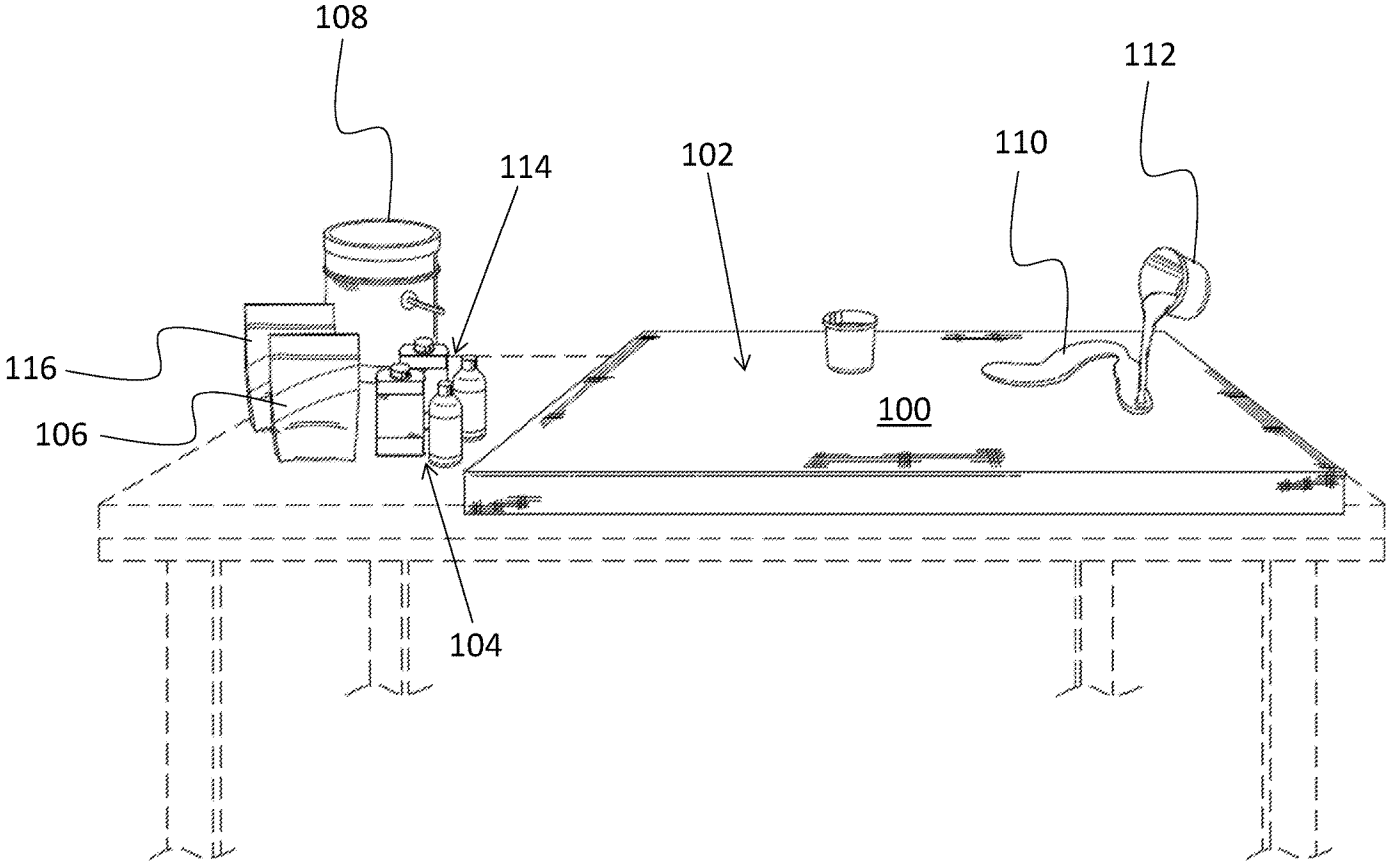
FIG. 1 is a perspective front view of a wall-mountable substrate having a paint-receiving upper surface and one or more materials which may be used to perform a method of creating decorative artwork in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient method of creating decorative artwork using a resin and a volatile sealer to produce at least one decorative marking which may have an aesthetically appealing multi-dimensional appearance. Embodiments of the invention provide a method of applying at least one coat of resin and at least one metallic substance to a piece of canvas that may be mounted on a wall within a building, e.g., a luxury art museum. In addition, embodiments of the method provide applying the volatile sealer to the paint-receiving upper surface at a velocity sufficient to disperse the metallic substance in more than one direction with respect to the paint-receiving upper surface to create the decorative marking.

Referring now to FIG. 1, one embodiment of the present invention is shown in a perspective front view. FIG. 1 shows several advantageous features of the present invention, but, as will be described below, the invention can be provided in several shapes, sizes, combinations of features and components, and varying numbers and functions of the components. The first example of a wall-mountable substrate 100, as shown in FIG. 1, includes a paint-receiving upper surface 102. In one embodiment, the wall-mountable substrate 100 may be a piece of canvas. The term "piece of canvas" is defined herein in its broadest possible sense as a piece of material, such as a piece of cloth, wood, or the like, that may be mounted on a wall, or otherwise displayed in a decorative manner. The piece of canvas may be a single piece of material or may be divided into more than one piece of material, e.g., a three panel canvas. In other embodiments, the wall-mountable substrate 100 may be another material used to create unique artwork thereon, such as a surfboard, skateboard, or the like.

Figure 2:
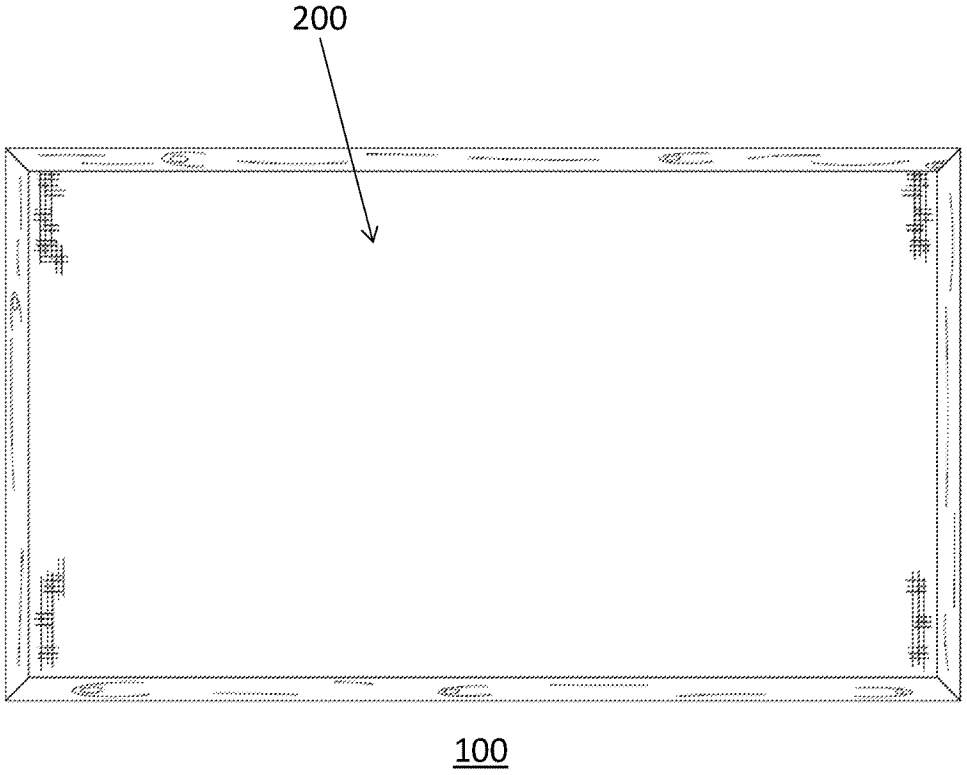
FIG. 2 is a rear elevational view of a wall-mounting surface of the wall-mountable substrate of FIG. 1 in accordance with the present invention.

As best shown in FIG. 2, in order to mount the wall-mountable substrate 100 on a surface, such as a wall surface in a luxury art museum, building, home, office, or the like, the wall-mountable substrate 100 may include a wall-mounting surface 200 opposite the paint-receiving upper surface 102 (FIG. 1). The wall-mountable substrate 100 may be placed at any location chosen by a user for decorative purposes, such as on an entry table, desk, floor, or the like.

Figure 7:
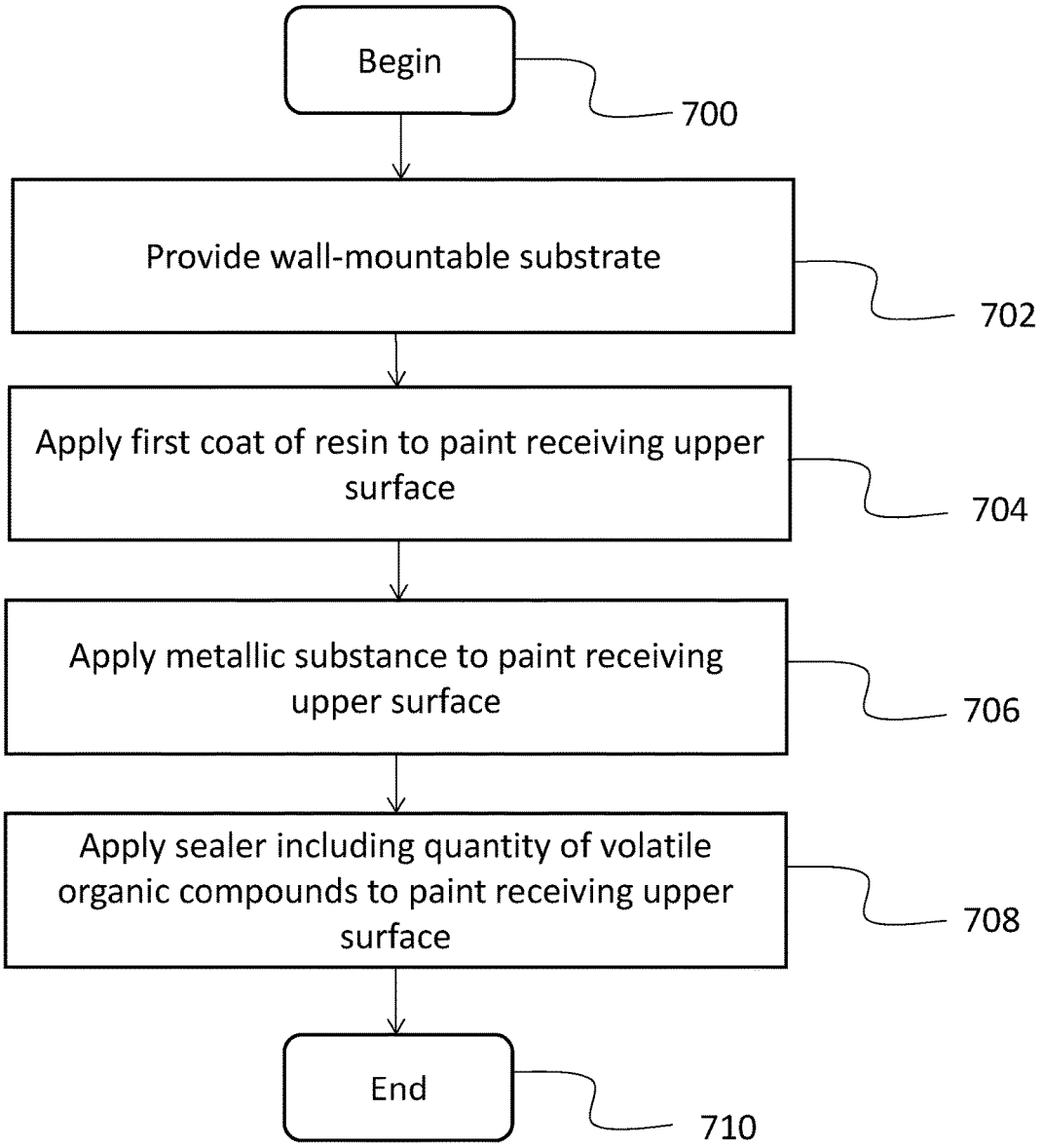
FIG. 7 is a process flow diagram depicting a method of creating decorative artwork in accordance with the present invention.

With reference again to FIG. 1, in conjunction with the process flow diagram of FIG. 7, there is provided a method of creating decorative artwork using a wall-mountable substrate, such as the wall-mountable substrate 100. The steps delineated in the exemplary process flow diagram of FIG. 7 are merely exemplary of the preferred order of creating decorative artwork, and said steps may be carried out in another order, with or without additional steps included therein. Also, two or more blocks shown in succession may be executed concurrently or with partial concurrence in some embodiments. Certain steps may also be omitted in FIG. 7. In some embodiments, some or all of the process steps included in FIG. 7 can be combined into a single process.

In one embodiment, the method begins at step 700 and moves directly to step 702, where a user provides the wall-mountable substrate 100. As used herein, "provides" means to purchase, build, make, bring into existence, or otherwise make available for use. In addition to providing the wall-mountable substrate 100, the method may include providing a number of materials used to perform the method of creating decorative artwork, which may be referred to herein as the artwork. In one embodiment, the materials may include at least a first resin 104, a metallic substance 106, and a sealer 108 having a quantity of volatile organic compounds, commonly referred to as "VOC," i.e., a volatile sealer.

The first resin 104, because such material is known to those of ordinary skill in the art, will be described generally herein. In one non-limiting embodiment, the first resin 104 may be any type of resin, such as a resin commonly used to create resin flooring. For example, the first resin 104 may be, without limitation, an epoxy resin, polyurethane resin, acrylic resin, a combination thereof, or another suitable resin. In other embodiments, the first resin 104 may be a type of resin commonly used to create countertops and the like. In performing the method, the user, e.g., an artist, may use more than one resin based on the user's desired preference for the finished piece of artwork. For example, the method may include the user painting or otherwise utilizing two resins of similar or contrasting colors, e.g., a blue and a white resin.

The metallic substance 106 may be a metallic powder, metallic liquid, or another suitable dispersible metallic appearing substance, and may or may not include an actual metal therein. The metallic appearing substance adds a shimmer effect to the artwork. Similar to the first resin 104, the metallic substance 106 may be in the form of any select color, e.g., silver, gold, copper, etc., to create a sheer or intense color of a metal within the artwork.

Unlike other methods of creating decorative artwork, the sealer 108 includes the quantity of VOC. The quantity of VOC present in the sealer 108 may vary depending on the type of sealer 108 selected by the user to perform the method. In one embodiment, the sealer 108 is a type of sealer commonly utilized in the concrete industry, e.g., a concrete sealer. More specifically, the sealer 108 may be a penetrating sealer or a topical sealer, such as an acrylic sealer, polyurethane sealer, epoxy sealer, or another suitable type of sealer, as commonly understood by one of skill in the art. In other embodiments, alternative types of sealers containing VOC may also be used and the description of the sealer 108 provided herein is not intended to be limited to any particular type of sealer 108 containing VOC.

In one embodiment, the method may include moving to step 704 including applying a first coat of the resin 110 to the paint-receiving upper surface 102 of the wall-mountable substrate 100. Prior to applying the first coat of resin 110, the user may apply an acrylic paint to the paint-receiving upper surface 102 that is of any color selected by the user. Naturally, the color of the acrylic paint will determine the ultimate color of the finished piece of artwork. For example, a white acrylic will produce a lighter appearance than the appearance perceived when a dark color, such as a dark blue, is applied to the paint-receiving upper surface 102.

In one embodiment, the present method includes applying the first coat of resin 110 by pouring the first coat of resin 110 from a container 112, e.g., a bucket, pail, etc., onto to the paint-receiving upper surface 102 of the wall-mountable substrate 100. In another embodiment, the method may include painting or otherwise using an applicator, e.g., a brush, scraper, etc., to apply the first coat of resin 110 to the paint-receiving upper surface 102. The term "coat" is defined herein in its broadest possible sense as a layer configured to at least partially cover the paint-receiving upper surface 102.

In one embodiment, the first coat of resin 110 is applied to a portion of the paint-receiving upper surface 102 that is less than the entire surface area of the paint-receiving upper surface 102. The portion of the paint-receiving upper surface 102 may vary according to the user's preference and in accordance with the desired appearance of the artwork in a finished form. For example, the user may apply the first coat of resin 110 in any pattern, such as by creating a swirl pattern. In another embodiment, the first coat of resin 110 may be applied to the entire surface area of the paint-receiving upper surface 102. As mentioned above, the first coat of resin 110 may be any color selected by the user.

In one embodiment, the method may proceed to step 706 including applying the metallic substance 106 to the paint-receiving upper surface 102. In one embodiment, the metallic substance 106 may be mixed with the first resin 104 prior to applying the first coat of resin 110 to the paint-receiving upper surface 102. Said another way, the metallic substance 106 and the first resin 104 may be simultaneously applied to the paint-receiving upper surface 102. In another embodiment, the metallic substance 106 may be applied to the paint-receiving upper surface 102 independent from the first resin 104, such as by pouring the metallic substance 106 from a container or otherwise using an applicator to apply the metallic substance 106 to the paint-receiving upper surface 102.

In one embodiment, the method may include curing the first coat of resin 110 to a user selected cure level prior to moving to the next step of the method. The user selected cure level may be between a range of 1 to 10, with 1 being a liquid state and 10 being a full hardness property, i.e., fully cured/hard. The user selected cure level may vary in accordance with the user's overall design goal for the artwork. In a preferred embodiment, the user selected cure level for the first coat of resin 110 may be a level in which the first resin 104 is relatively firm yet mobile, i.e., prior to gelation, such as a level 5. In other embodiments, the user selected cure level may be after gelation. In one embodiment, the time period between the application of the first coat of resin 110 to paint-receiving upper surface 102 and the curing of the first coat of resin 110 to the user selected cure level may be approximately 20-30 minutes. In other embodiments, the time period may be outside of this range and may vary according to outside factors, such as heat and humidity.

Figure 3:
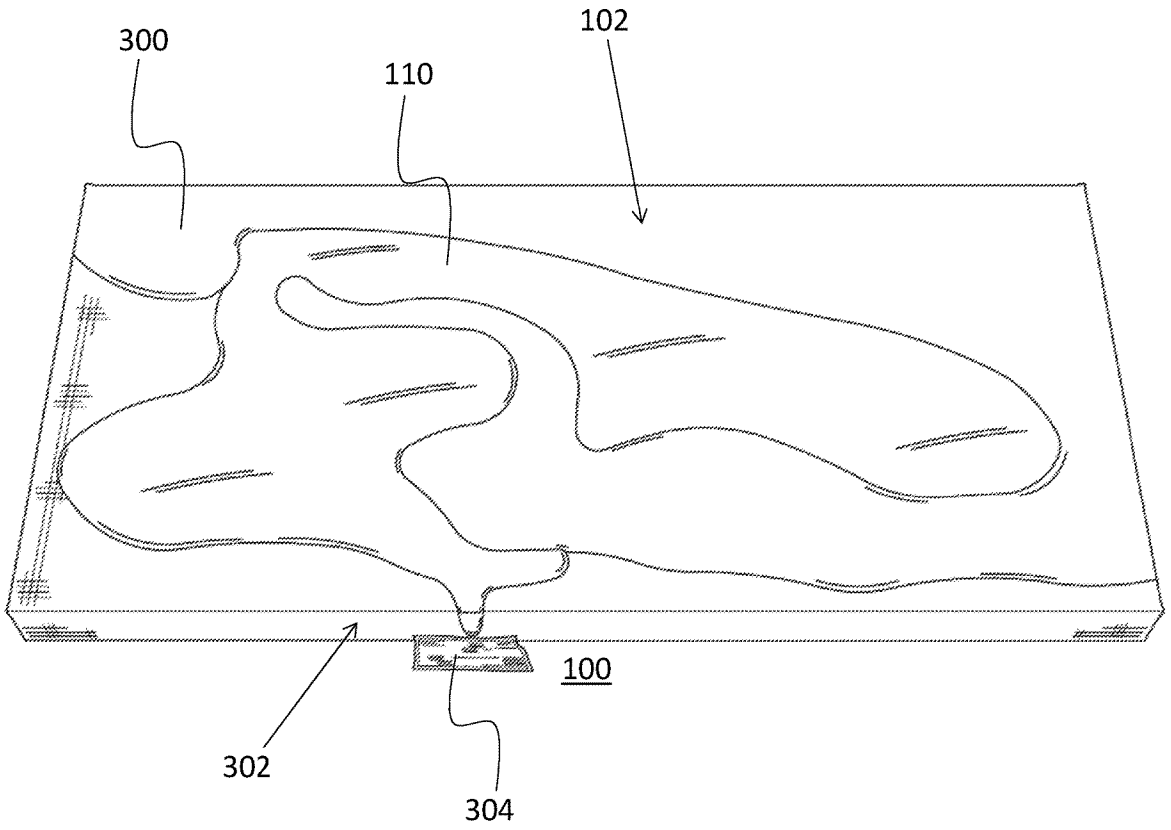
FIG. 3 is a perspective front view of the paint-receiving upper surface of FIG. 1 including a first layer of resin and a second layer of resin being applied to the paint-receiving upper surface in accordance with the present invention.

With reference now to FIG. 3, depicting a perspective view of the wall-mountable substrate 100, in conjunction with FIG. 1, in one advantageous embodiment, in order to increase the aesthetic appeal of the artwork through the use of a variety of patterns and/or colors, the method may include using a second resin 114 (FIG. 1). More specifically, the present method may include applying the second resin 114 (FIG. 1), which may be referred to herein as a second coat of resin 300 (FIG. 3), to the paint-receiving upper surface 102 in addition to the first coat of resin 110. The second coat of resin 300 may be applied in any manner described with respect to the first coat of resin 110 and may be any select color. The description of the first resin 104 and the first coat of resin 110 are intended to apply to the second resin 114 and the second coat of resin 300 and are not repeated for the sake of brevity.

In one embodiment, the method includes applying the second coat of resin 300 to the paint-receiving upper surface 102 such that the second coat of resin 300 is at least partially isolated from the first coat of resin 110. More specifically, when the first coat of resin 110 has reached the user selected cure level, when applying the second coat of resin 300 to the paint-receiving upper surface 102, the second coat of resin 300 may be isolated from, i.e., does not combine with in an easily observable way, the first coat of resin 110 due to the firmness of the first coat of resin 110. The second coat of resin 300 may be cured to the user selected cure level, as described above with respect to the first coat of resin 110 prior to moving forward with the next step of the present method.

With reference again to FIG. 1, similar to the metallic substance 106, a second metallic substance 116 may be applied to the paint-receiving upper surface 102. In one embodiment, the second metallic substance 116 may be mixed with the second resin 114 prior to applying the second coat of resin 300 to the paint-receiving upper surface 102. Said another way, the second metallic substance 116 and the second resin 114 may be simultaneously applied to the paint-receiving upper surface 102. In another embodiment, the second metallic substance 116 may be applied to the paint-receiving upper surface 102 independent from the second resin 114. In other embodiments, the second metallic substance 116 may be mixed with the first resin 104. In the same vein, the metallic substance 106 may be mixed with the second resin 114.

With reference again to FIG. 3, in contrast to known methods of producing resin flooring in which it may be physically impossible to manually move the flooring, the present method may include the user manually tilting the wall-mountable substrate 100 at an angle to spread the first coat of resin 110 and/or the second coat of resin 300 over a select portion of the paint-receiving upper surface 102. The select portion can be any portion of the paint-receiving upper surface 102 selected by the user, e.g., a right side, a left side, a middle portion, or a combination thereof. In one exemplary embodiment, the user may manually hold at least one side of the wall-mountable substrate 100 to tilt the wall-mountable substrate 100 at an angle that is approximately 45-60 degrees relative to a ground surface, such as a floor. In other embodiments, the user may manually tilt the wall-mountable substrate 100 at an angle that is greater or less than approximately 45-60 degrees relative to the ground surface.

In one embodiment, the method may include allowing the first coat of resin 110 to drip over at least a portion of a perimeter 302 of the wall-mountable substrate 100. Thereafter, the user may wipe the portion of the perimeter 302 with a piece of material 304, such as a cloth, glove, scraping device, or the like, to collect a quantity of the first coat of resin 110 and distribute the quantity to the paint-receiving upper surface 102. In one non-limiting embodiment, the portion of the perimeter 302 is a side of the perimeter. As such, wiping and distributing the first coat of resin 110 in this manner not only covers the perimeter 302 for a finished look, but provides maximum use of the first coat of resin 110.

Figure 4:
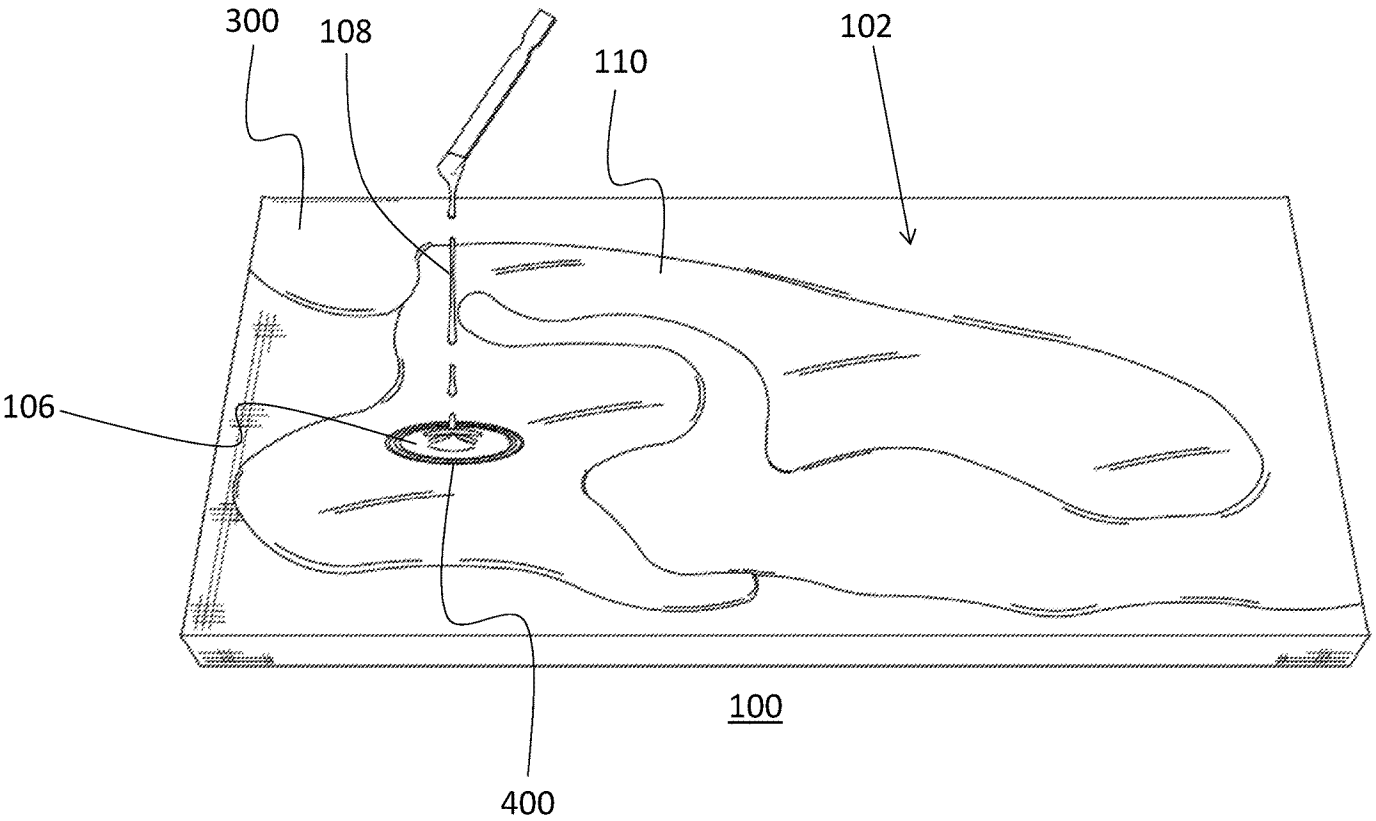
FIG. 4 is a perspective front view of the paint-receiving upper surface of FIG. 1 depicting a volatile sealer being applied to the paint-receiving upper surface in accordance with the present invention.

With reference now to FIG. 4, depicting a perspective view of the paint-receiving upper surface 102 of the wall-mountable substrate 100, in one advantageous embodiment, the method proceeds to step 708 including applying the sealer 108 to the paint-receiving upper surface 102 at a velocity sufficient to disperse the metallic substance 106 in one or more directions with respect to the paint-receiving upper surface 102 to create at least one decorative marking 400. Said another way, the sealer 108 may be released by the user a distance away from the paint-receiving upper surface 102 at a speed sufficient to cause the sealer 108 to impact the paint-receiving upper surface 102 to infiltrate and disperse the first coat of resin 110 and/or the metallic substance 106 to produce the decorative marking 400. Advantageously, when the sealer 108 is applied to the metallic substance 106, because the sealer 108 includes the VOC, the sealer 108 is configured to separate and cause a portion of the metallic substance 106 to coagulate, leaving one or more metallic infused details, such as a metallic ring or vein pattern, i.e., the decorative marking 400. The decorative marking 400 may be one or more metallic rings, semi-circles, a vein pattern, one or more curved lines, or another marking. Through the application of the sealer 108, the user is beneficially provided with the artwork having a distinguished appearance that can be tailored to suit the aesthetic taste of numerous art enthusiasts.

In contrast to known methods of applying a sealer directly to a concrete floor using an applicator, such as a brush or mop, in one non-limiting embodiment, the sealer 108 may be released from an applicator, such as a paint stick, brush, or the like, that is disposed a distance away from the paint-receiving upper surface 102. In one embodiment, the distance away from the paint-receiving upper surface 102 may be 2-12 inches. In another embodiment, the distance may be at least 36 inches away from the paint-receiving upper surface 102 in a direction toward the user, such as when the user is standing on an elevational platform, such as a ladder. In other embodiments, the distance may be outside of this range.

In one embodiment, as opposed to the sealer 108 dispersing only the metallic substance 106, step 708 may include applying the sealer 108 to the paint-receiving upper surface 102 at a velocity sufficient to disperse both the first coat of resin 110 and the metallic substance 106 in one or more directions with respect to the paint-receiving upper surface 102 to create the decorative marking 400. In this embodiment, the metallic substance 106 may be coupled to, i.e., mixed within, the first coat of resin 110. The present method may include applying the sealer 108 in the same or a similar manner to the first coat of resin 110, the second coat of resin 300, the second metallic substance 116, or a combination thereof to create one or more decorative markings 400.

In some embodiments, the decorative marking 400 may have a 3D appearance when viewed by an observer. More specifically, although the decorative marking 400 may be substantially planar to the touch, the decorative marking 400 may appear multi-dimensional when viewed by the observer, such as an admirer at a luxury art gallery. More specifically, the decorative marking 400 may appear to include a width, height, and depth, although the decorative marking 400 is only one-dimensional.

In one embodiment, step 708 may include applying the sealer 108 to the paint-receiving upper surface 102 when the user selected cure level of the first coat of resin 110 and/or the second coat of resin 300 (FIG. 3) is of a viscosity less than the liquid level but greater than the full hardness level. As such, when the sealer 108 comes into contact with the first coat of resin 110 and/or the second coat of resin 300, the sealer 108 may be configured to briefly halt the curing process and disperse the metallic substance 106 to create the decorative marking 400.

In one embodiment, the sealer 108 may be applied to the paint-receiving upper surface 102 at a user selected time period which may correspond to the user selected cure level. More specifically, in one embodiment, the user selected time period may be a point in time that is approximately 30-45 minutes after the application of the first layer of resin 110. Naturally, the user selected time period may vary depending upon the desired cure level and the duration of time needed to reach the user selected cure level. In other embodiments, the sealer 108 may be applied at a time period that it out of this range.

Figure 5:
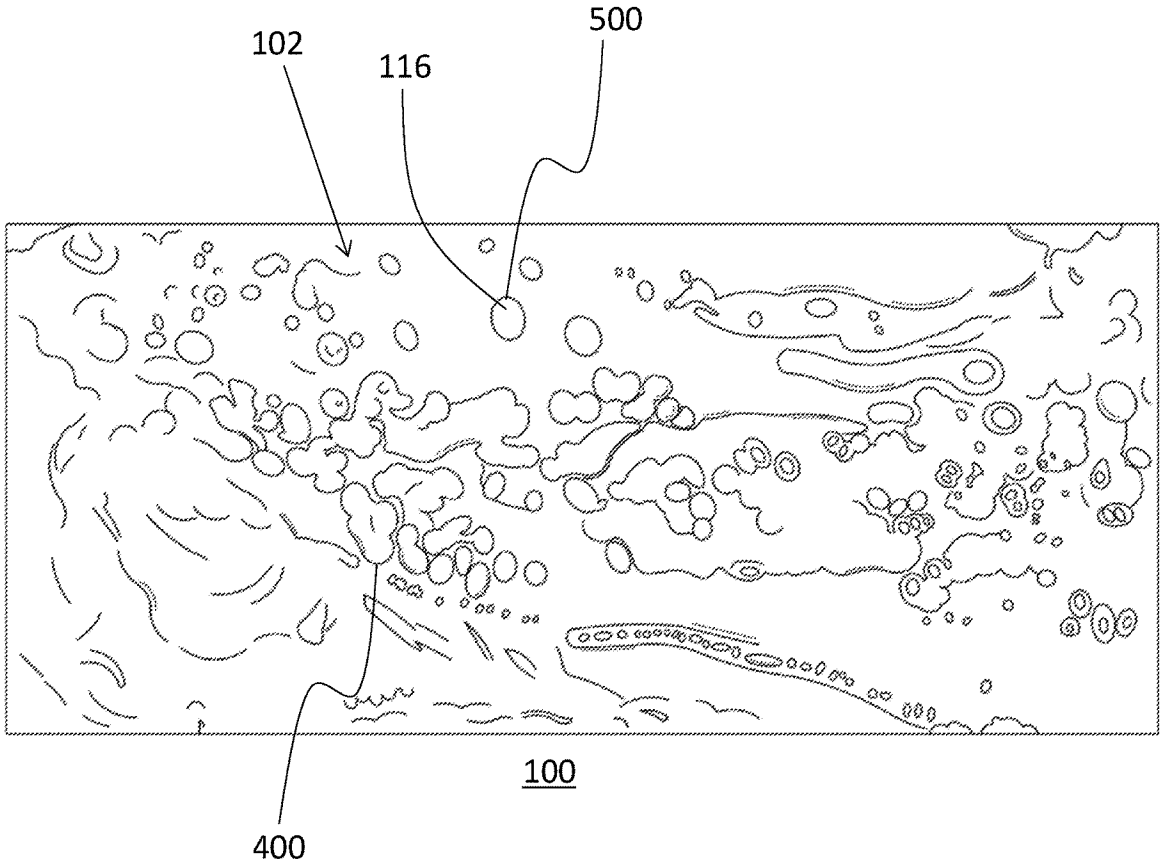
FIG. 5 is an elevational front view of the wall-mountable substrate in a finished form depicting a first decorative image different than a second decorative image.

With reference to FIG. 5, depicting a perspective front view of the wall-mountable substrate 100 in a finished form, i.e., the decorative artwork, in one embodiment, the second metallic substance 116 may be dispersed in more than one direction with respect to the paint-receiving upper surface 102 to create a second decorative marking 500 different than the decorative marking 400. The second decorative marking 500 may be one or more rings, semi-circles, a vein pattern, one or more curved lines, or another marking.

Figure 6:
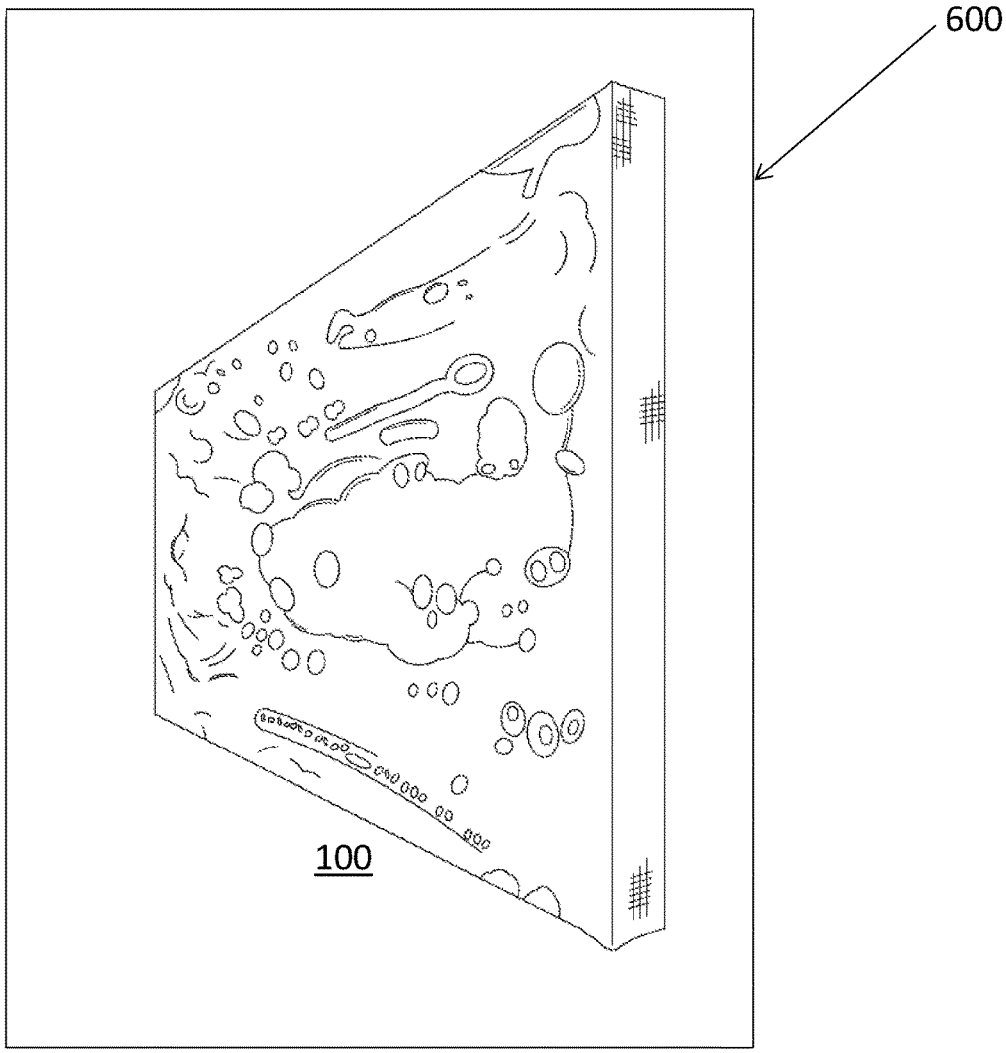
FIG. 6 is a perspective side view of the wall-mountable substrate mounted on a wall surface in accordance with an exemplary embodiment of the present invention.

With reference to FIG. 6, depicting a perspective side view of the wall-mountable substrate 100, in conjunction with FIG. 2, in one embodiment, the method may include mounting the wall-mounting surface 200 (FIG. 2) of the wall-mountable substrate 100 on a wall surface 600 in a longitudinal direction with respect to a longitudinal direction of the wall surface 600. The wall surface 600 is not limited to any particular location and may be the wall surface 600 of a luxury art museum, building, home, office, or the like.

In one embodiment, the method may include mounting the wall-mountable substrate 100 on the wall surface 600 using any conventional mounting means, such as through portrait mounting hardware. In another embodiment, the method may include mounting the wall-mountable substrate 100 on the wall surface 600 using non-conventional mounting methods. Of course, the user may also position the wall-mountable substrate 100 on a desk, table, floor, or another location as chosen by the user. The method ends at step 710.

A method of creating decorative artwork has been disclosed that includes the use of a resin and a volatile sealer. Embodiments of the invention provide the method including applying at least one coat of the resin and at least one metallic substance to a paint-receiving upper surface of a wall-mountable substrate, such as a piece of canvas, that may be mounted on a wall within a building, such as a luxury art museum. In addition, embodiments of the method provide applying the volatile sealer to the paint-receiving upper surface at a velocity sufficient to disperse the metallic substance in one or more directions with respect to the paint-receiving upper surface to produce at least one aesthetically appealing decorative marking which may have a multi-dimensional appearance.

What is claimed is:

1. A method of creating decorative artwork, the method comprising:

providing a wall-mountable substrate having a paint-receiving upper surface and a wall-mounting surface opposite the paint-receiving upper surface;

applying a first coat of resin to the paint-receiving upper surface;

applying a metallic substance to the paint-receiving upper surface; and applying a volatile sealer to the paint receiving upper surface at a velocity sufficient to disperse at least one of the first coat of resin and the metallic substance in a plurality of directions with respect to the paint-receiving upper surface to create at least one decorative marking.

2. The method according to claim 1, further comprising:

mixing the metallic substance with the first coat of resin such that the step of applying a first coat of resin to the paint-receiving upper surface and the step of applying a metallic substance to the paint-receiving upper surface are performed in a single step.

3. The method according to claim 1, further comprising:

manually tilting the wall-mountable substrate at an angle to spread the first coat of resin over a portion of the paint-receiving upper surface.

4. The method according to claim 1, further comprising:

curing the first coat of resin to a user-selected cure level, the user-selected cure level being between a range of 1 to 10, with 1 being a liquid state and 10 being a full hardness property.

5. The method according to claim 1, further comprising:

applying a second coat of resin to the paint-receiving upper surface such that the second coat of resin is at least partially isolated from the first coat of resin;

applying at least one of the metallic substance and a second metallic substance to the second coat of resin; and applying the volatile sealer to the paint-receiving upper surface at a velocity sufficient to disperse at least one of the second coat of resin and the second metallic substance in a plurality of directions with respect to the paint-receiving upper surface to create a second decorative marking having a 3D appearance.

6. The method according to claim 1, further comprising:

allowing the first coat of resin to drip over at least a portion of a perimeter of the wall-mountable substrate;

collecting a quantity of the first coat of resin that dripped over the at least a portion of the perimeter of the wall-mountable substrate; and distributing the quantity of the first coat of resin that dripped over the at least a portion of the perimeter of the wall-mountable substrate back onto the paint-receiving upper surface.

7. The method according to claim 1, wherein:

the first coat of resin is a mixture of resin and the volatile sealer.

8. The method according to claim 1, further comprising:

applying the volatile sealer to the paint-receiving upper surface from a user selected height, wherein the user selected height is at least thirty six inches away from the paint-receiving upper surface.

9. The method according to claim 1, wherein:

the volatile sealer is at least one of a topical sealer and a penetrating sealer.

10. The method according to claim 1, further comprising:

mounting the wall-mounting surface of the wall-mountable substrate on a wall surface of a building structure.

11. A method of creating decorative artwork, the method comprising:

providing a piece of canvas having a paint-receiving upper surface and a mounting surface opposite the paint-receiving upper surface;

applying a first coat of resin to the paint-receiving upper surface;

curing the first coat of resin to a user-selected cure level of a viscosity greater than a liquid level and less than full hardness level;

applying a metallic substance the paint-receiving upper surface; and applying a volatile sealer to the metallic substance wherein the first coat of resin reaches the user-selected cure level such that the volatile sealer disperses the metallic substance in a plurality of directions with respect to the paint-receiving upper surface to create at least one decorative marking.

12. The method according claim 11, further comprising:

applying a second coat of resin to the paint-receiving upper surface;

mixing the metallic substance with at least one of the first coat of resin and the second coat of resin; and applying the volatile sealer to the metallic substance and the at least one of the first coat of resin and the second coat of resin to create the at least one decorative marking.

13. The method according to claim 12, further comprising:

manually tilting the piece of canvas to a user-selected angle to spread at least one of the first coat of resin and the second coat of resin over a portion of the paint-receiving upper surface.

14. The method according to claim 11, further comprising:

allowing the first coat of resin to drip over at least a portion of a perimeter of the piece of canvas;

collecting a quantity of the first coat of resin that dripped over the at least a portion of a perimeter of the piece of canvas; and distributing the quantity of the first coat of resin that dripped over the at least a portion of a perimeter of the piece of canvas back onto the paint-receiving upper surface.

15. The method according to claim 11, wherein:

the volatile sealer is one of an acrylic sealer and an epoxy sealer.

16. The method according to claim 11, wherein:

the at least one decorative marking includes a multi-dimensional appearance.

17. A method of creating decorative artwork, the method comprising:

providing a substrate having a paint-receiving upper surface and a mounting surface opposite the paint-receiving upper surface;

applying a coat of resin to the paint-receiving upper surface;

curing the coat of resin to a user selected cure level of a viscosity greater than a liquid level and less than full hardness level;

applying a metallic substance to the paint-receiving upper surface; and releasing a volatile sealer onto the paint-receiving upper surface for a user selected time period and at a velocity sufficient to disperse at least one of the coat of resin and the metallic substance over a portion of the paint-receiving upper surface to create at least one decorative marking.

18. The method according to claim 17, wherein:

the volatile sealer is a concrete sealer.

19. The method according to claim 17, further comprising:

applying a second coat of resin to the paint-receiving upper surface;

applying the at least one of the metallic substance and a second metallic substance to the second coat of resin; and applying the volatile sealer to the paint-receiving upper surface at a velocity sufficient to disperse the second metallic substance in a plurality of directions with respect to the paint-receiving upper surface to create a second decorative marking different than the at least one decorative marking.

20. The method according to claim 17, further comprising:

manually tilting the substrate at an angle to spread the coat of resin over a portion of the paint-receiving upper surface.

* * * * *